US006416710B1

(12) United States Patent
Oshiro et al.

(10) Patent No.: US 6,416,710 B1
(45) Date of Patent: Jul. 9, 2002

(54) HIGH-STRENGTH ALUMINUM ALLOY FOR PRESSURE CASTING AND CAST ALUMINUM ALLOY COMPRISING THE SAME

(75) Inventors: Naoto Oshiro; Takao Suzuki, both of Yao; Hiroyuki Omura; Izumi Murashima, both of Tokyo, all of (JP)

(73) Assignee: G.D. Searle & Co., Skokie, IL (US)

( * ) Notice: Subject to any disclaimer, the term of this patent is extended or adjusted under 35 U.S.C. 154(b) by 0 days.

(21) Appl. No.: 09/569,032

(22) Filed: May 11, 2000

(30) Foreign Application Priority Data

May 12, 1999 (JP) ..... 11-131736
May 28, 1999 (JP) ..... 11-150576
May 1, 2000 (JP) ..... 2000-132662

(51) Int. Cl.[7] ..... C22C 21/02
(52) U.S. Cl. ..... 420/534; 420/537
(58) Field of Search ..... 420/534, 537

(56) References Cited

U.S. PATENT DOCUMENTS 3,765,877 A * 10/1973 Sperry et al. ..... 75/142

FOREIGN PATENT DOCUMENTS

JP 57-126944 * 8/1982

OTHER PUBLICATIONS

Metals Handbook Desk Edition, 2nd Ed., 1998, p 775.*

* cited by examiner

*Primary Examiner*—George Wyszomierski
*Assistant Examiner*—Janelle Combs-Morillo

(57) ABSTRACT

A high-strength aluminum alloy for pressure casting exhibiting a tensile strength of not less than 35 kgf/mm$^2$ and an elongation of not less than 5.0% is provided. The aluminum alloy comprises 3.5 to 5.0% of Cu, 6.5 to 7.5% of Si, not more than 0.36% of Mg, not more than 0.35% of Fe, and the balance comprising Al and unavoidable impurities.

10 Claims, 2 Drawing Sheets

HIGH-STRENGTH ALUMINUM ALLOY FOR PRESSURE CASTING AND CAST ALUMINUM ALLOY COMPRISING THE SAME

BACKGROUND OF THE INVENTION

1. Field of the Invention

The present invention relates to a high-strength aluminum alloy for pressure casting having superior tensile strength, elongation and impact value, and to a high-strength cast aluminum alloy comprising the same.

2. Description of the Prior Art

Aluminum alloys are widely used as materials for various components of vehicles, industrial machines, airplanes, electric appliances for domestic use and other apparatus of various types. Among such aluminum alloys there are cast aluminum alloys. Examples of typical cast aluminum alloys include cast Al—Si alloys, representatives of which include ADC10 and ADC12. Such cast Al—Si alloys have been frequently used for cover components and casing components of vehicles such as carburetors, cylinder blocks and cylinder head covers and for cast components of other articles, especially die-cast components.

From the viewpoint of lightening vehicles and other machines in the recent energy-saving trend, die-cast materials are to be positively utilized even for components that are expected to receive a substantial force. Die-cast materials to be used in such applications need to satisfy desired cost efficiency as well as necessary castability and exhibit a higher tensile strength (not less than 35 kgf/mm$^2$), a higher tenacity, and a superior elongation (not less than 5.0%).

Conventionally-used ADC10 and ADC12 as die-cast, however, exhibit a tensile strength as small as 23 to 25 kgf/mm$^2$ and an elongation as small as 1.4 to 1.5% which are remote from the foregoing requirements (refer to Table 3).

SUMMARY OF THE INVENTION

It is, therefore, an object of the present invention to develop a high-strength aluminum alloy for pressure casting which satisfies the desired cost efficiency as well as the necessary castability, can replace ADC10 or ADC12, and can provide a high-strength cast aluminum alloy having a tensile strength of not less than 35 kgf/mm$^2$ and an elongation of not less than 5.0% by being subjected to a T6 treatment after pressure casting.

The foregoing and other objects, features and attendant advantages of the present invention will become apparent from the reading of the following detailed description with reference to the drawings.

DETAILED DESCRIPTION OF THE PREFERRED EMBODIMENTS

Figure 1:
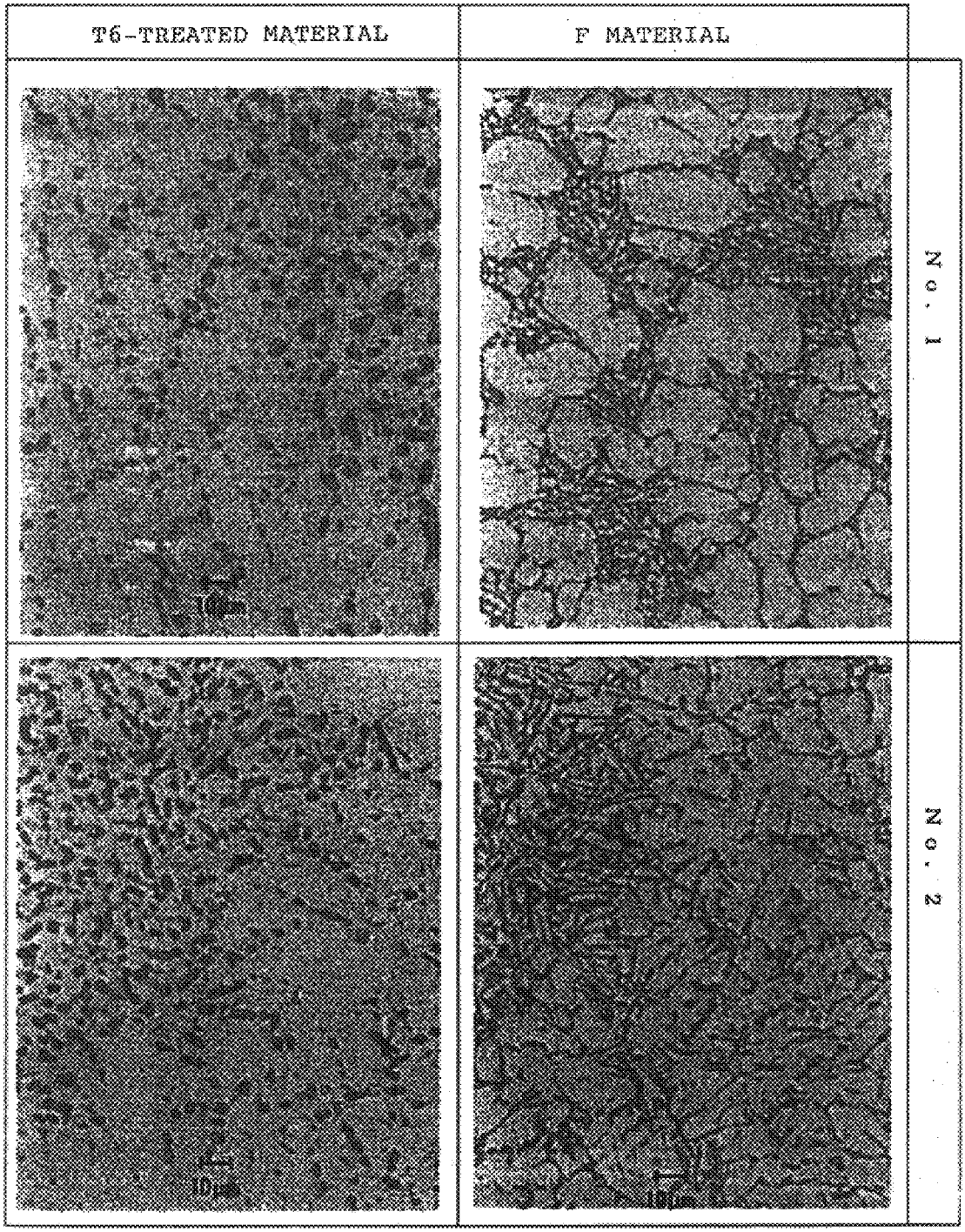
FIG. 1 is a microscopic photograph showing respective texture of alloys Nos. 1 and 2 of the invention, as pressure-cast and as T6-treated after the pressure casting.

The present invention will now be described in detail with reference to the preferred embodiments thereof.

High-strength aluminum alloys for pressure casting according to the present invention, in general, comprise Cu: 3.5–5.0%, Si: 6.5–7.5%, Mg ≦0.36%, Fe ≦0.35%, and the balance comprising Al and unavoidable impurities. These alloys correspond to conventional Al—Si—Cu alloys for die casting, representatives of which include ADC10 and ADC12. Respective composition of ADC10 and ADC12 is shown in TABLE 1.

TABLE 1

| | ADC10 | ADC12 |
|---|---|---|
| Cu (%) | 2.0–4.0 | 1.5–3.5 |
| Si (%) | 7.5–9.5 | 9.6–12.0 |
| Mg (%) | 0.3 or less | 0.3 or less |
| Zn (%) | 1.0 or less | 0.3 or less |
| Fe (%) | 1.3 or less | 1.3 or less |
| Mn (%) | 0.5 or less | 0.5 or less |
| Ni (%) | 0.5 or less | 0.5 or less |
| Sn (%) | 0.3 or less | 0.3 or less |
| Al (%) | BALANCE | BALANCE |

The alloy of the present invention, as pressure-cast, is not largely different from the conventional alloys such as ADC10 and ADC12 in tensile strength and elongation. However, the alloy of the present invention is turned into an alloy exhibiting a tensile strength of not less than 35 kgf/mm$^2$ and an elongation of not less than 5.0% by a subsequent heat treatment such as a T6 treatment. In the solution treatment of the T6 treatment, it is required that the temperature be usually maintained between 510° C. and 525° C. for a deposited intermetallic compound such as $CuAl_2$ to readily form a solid solution in the parent phase. The time period for which the temperature of the solution treatment is maintained becomes shorter as that grows higher. For example, the temperature maintaining time is about six hours when the solution treatment temperature is 520° C. The temperature maintaining time may be longer than this time period, or may be shorter so long as the desired solid solution can be formed.

The temperature of an aging treatment is a temperature at which a desired intermetallic compound is formed as an intermediate phase in the parent phase, for example, 160°–1700° C. When the aging temperature is set to 160° C., the aging treatment is performed for about seven hours. When the aging temperature is set to 170° C., the aging treatment is performed for about six hours. The aging time and temperature have to be determined so as not to cause overaging.

For comparison, ADC10 and ADC12 were each subjected to a solution treatment at 500° C., which was slightly lower than the temperature described above, for six hours, and then watercooled to room temperature, followed by an age-hardening treatment at 160° C. for seven hours. Any one of ADC10 and ADC12 thus treated exhibited a tensile strength of not more than 35 kgf/mm$^2$. In contrast, alloys Nos. 1 to 5 of the present invention each exhibited a tensile strength of about 37–46 kgf/mm$^2$ after having undergone the T6 treatment. Thus, the desired tensile strength, or not less than 35 kgf/mm$^2$ was attained. Further, the T6-treated alloys of the present invention exhibited an average elongation of not less than 5.0% though scattering of results was observed around 5.0%.

As described above, the alloy of the present invention is particularly suitable for pressure casting and will exhibit desired performance after having undergone the T6 treatment. Since common die casting provides castings having a low density due to numerous voids caused therein, the T6 treatment cannot improve the strength of such castings produced by the common die casting. However, the pressure casting provides castings having a higher density and hence is suitable for the manufacture of high-strength aluminum castings having a higher density. The component analysis of examples of the present invention is shown in TABLE 2.

TABLE 2

| | Cu (%) | Si (%) | Mg (%) | Fe (%) |
|---|---|---|---|---|
| NO. 1 | 4.6 | 7.0 | 0.20 | 0.21 |
| NO. 2 | 4.7 | 7.0 | 0.36 | 0.23 |
| NO. 3 | 4.1 | 7.0 | 0.01 | 0.21 |
| NO. 4 | 4.4 | 6.9 | 0.24 | 0.22 |
| NO. 5 | 4.3 | 6.6 | 0.17 | 0.29 |
| COMP. EX. 1 | 2.9 | 7.3 | 0.19 | 0.18 |
| COMP. EX. 2 | 4.1 | 8.8 | 0.22 | 0.12 |
| COMP. EX. 3 | 4.5 | 7.1 | 0.42 | 0.19 |
| COMP. EX. 4 | 4.8 | 7.1 | 0.27 | 0.41 |

Note that: alloys Nos. 1–5 were examples of the present invention; COMP. EX. 1 had a lower limit Cu content, whereas COMP. EX. 2 to 4 had upper limit contents of Si, Mg and Fe, respectively; the contents of other components except Al were not more than 0.01% each.

A pressure-cast material (hereinafter referred to as " F material) made from each of the alloys Nos. 1 and 2 shown in the microscopic photograph of FIG. 1 was made by shortening the time period from the supply of molten metal to the pouring sleeve until the completion of the pouring to one second or shorter and rapidly cooling to a certain extent in the pressure casting. As can be seen from the photograph, an α-Al phase in the casting texture is coarse, and an eutectic Si texture intermediate the α-Al phase is in the form of large needle crystal. For this reason, the strength and elongation of the F materials did not reach the desired values. In fact, the alloy of the present invention as pressure-cast does not make a great difference from the conventional ADC10 or ADC12 in tensile strength and elongation (refer to TABLE 3).

Test pieces cut out of pressure-cast articles made from ADC10 and ADC12 were subjected to a tensile test to compare with the F materials made from the alloys of the present invention. The results of the test are shown in TABLE 3.

TABLE 3

| | TENSILE STRENGTH ($kgf/mm^2$) | 0.2% PROOF STRENGTH ($kgf/mm^2$) | ELONGATION (%) |
|---|---|---|---|
| NO. 1 | 24.6 | 9.4 | 4.9 |
| NO. 2 | 23.5 | 8.5 | 3.6 |
| NO. 3 | 23.5 | 8.5 | 3.6 |
| ADC10 | 24.6 | 16.0 | 1.5 |
| ADC12 | 22.9 | — | 1.1 |

Next, the F materials made from the alloys of the present invention, comparative examples and the conventional alloys were subjected to a heat treatment, for example, T6 treatment.

The T6 treatment was performed under the following conditions:

for alloys Nos. 1–3 of the invention:

solution treatment at 520° C. for 6 hours, then age-hardening treatment at 160° C. for 7 hours; for alloys Nos. 4 and 5 of the invention, comparative examples 1 and 3, and ADC10 and ADC12:

solution treatment at 500° C. for 6 hours, then age-hardening treatment at 160° C. for 7 hours;

for comparative example 2:

solution treatment at 510° C. for 6 hours, then age-hardening treatment at 180° C. for 4 hours; and for comparative example 4:

solution treatment at 515° C. for 6 hours, then age-hardening treatment at 160° C. for 7 hours.

Samples of these materials were tested for tensile strength, 0.2% proof strength and elongation. The results of the test are shown in TABLE 4.

TABLE 4

| | TENSILE STRENGTH ($kgf/mm^2$) | 0.2% PROOF STRENGTH ($kgf/mm^2$) | ELONGATION (%) |
|---|---|---|---|
| NO. 1 | 46.1 | 37.6 | 5.1 |
| NO. 2 | 45.4 | 36.4 | 5.8 |
| NO. 3 | 37.6 | 20.0 | 11.1 |
| NO. 4 | 41.8 | 36.9 | 5.0 |
| NO. 5 | 38.4 | 28.8 | 5.6 |
| COMP. EX. 1 | 34.6 | 24.4 | 6.7 |
| COMP. EX. 2 | 46.3 | 41.8 | 3.2 |
| COMP. EX. 3 | 35.9 | 33.0 | 0.8 |
| COMP. EX. 4 | 39.1 | 31.8 | 3.5 |
| ADC10 | 38.0 | 30.3 | 3.2 |
| ADC12 | 37.8 | 29.3 | 3.5 |

Note that: COMP. EX. 1 had a lower limit Cu content, whereas COMP. EX. 2 to 4 had upper limit contents of Si, Mg and Fe, respectively.

As seen from TABLE 4, the T6-treated alloys of the present invention exhibited a tensile strength of not less than 35 $kgf/mm^2$ and an elongation of not less than 5.0%.

Figure 2:
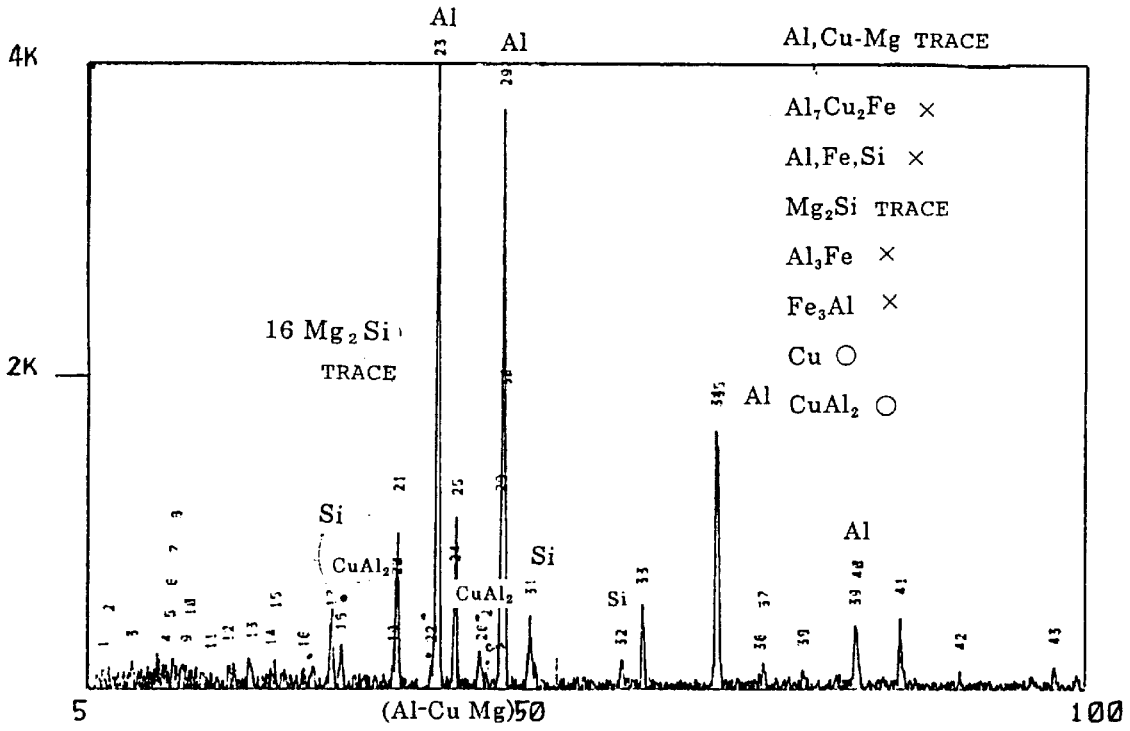
FIG. 2 is an X-ray diffraction pattern of an alloy according to the present invention.

Microscopic photographs shown in FIG. 1 of the T6-treated alloys Nos. 1 and 2 were taken for examining respective texture, and a sample of an alloy of the invention which was subjected to averaging after the T6 treatment was analyzed by X-ray diffraction, the results of the analysis are shown in FIG. 2. As a result, the α-Al phase was found to become finer, and deposition of a minute metallic intermediate phase was observed to be deposited within the α-Al phase. Thus, the alloy of the present invention was strengthened. The minute metallic intermediate phase observed in the α-Al phase was a $CuAl_2$ intermediate phase found at Nos. 18 and 26 in FIG. 2. Other intermediate phases such as $Mg_2Si$ in trace amounts were observed. Further, eutectic Si was observed to become finer and spheroidized. From these facts, it can be understood that the mechanical properties of the alloy of the present invention were improved by the T6 treatment. Thus, the heat treatment enables the alloy of the present invention to have characteristics of desired values.

It should be noted that: the addition of Cu enhances the strength of a cast aluminum alloy by forming a Cu—Al intermetallic compound such as $CuAl_2$; the addition of Si improves the castability of an aluminum alloy; the addition of Mg enhances the strength of a cast aluminum alloy by forming a Mg—Si intermetallic compound such as $Mg_2Si$, like the addition of Cu; and the addition of Fe prevents seizure of a cast article by a mold.

EXAMPLE

Alloys Nos. 1 to 5 of the present invention shown in TABLE 2 were pressure-cast to provide samples of F materials. The samples of the F materials were then subjected to the T6 treatment. For comparison, comparative examples 1 to 4 and ADC10 and ADC12 were treated under the same conditions as with the alloys of the present invention. Respective composition of ADC10 and ADC12 was the same as shown in TABLE 1. Respective composition of the alloys Nos. 1 to 5 was the same as shown in TABLE 2.

If the content of Cu is as small as about 2.9% as in comparative example 1, the strength of the α-Al phase cannot be sufficiently enhanced, with the result that the desired tensile strength cannot be attained. Further, the upper limit of Cu content which can make solid solution is about 4.9% and, hence, the addition of Cu in an amount of 5.0% or more is useless, or rather may affect the formation of solid solution of the $CuAl_2$ phase thereby degrading the mechanical properties of the resulting casting. For this reason, a Cu content of 3.5 to 5.0% is effective.

If the content of Si is as large as about 8.8% as in comparative example 2, the elongation decreases to a value lower than desired. However, if the content of Si is insufficient, the fluidity of the alloy is too low to suit pressure casting. Therefore, a Si content of 6.5 to 7.5% is effective.

If the content of Mg is as large as about 0.42% as in example 3, the elongation of a casting decreases substantially. A Mg content of not more than 0.36% is suitable (refer to alloy No. 2). However, if the Mg content of an alloy is smaller than that of alloy No. 2, the tensile strength and 0.2% proof strength of the resulting casting are insufficient though the elongation thereof increases. It is recommendable that the content of Mg be adjusted depending on the application. When the application attaches a greater importance to the tensile strength and 0.2% proof strength, the content of Mg preferably ranges between 0.2% and 0.36%. On the other hand, when the application attaches a greater importance to the elongation, the content of Mg is preferably not more than 0.2%.

If the content of Fe is as large as about 0.41% as in comparative example 4, the elongation decreases. Therefore, it is required that the content of Fe be not more than 0.35%. Since Fe is effective in preventing seizure, a Fe content of 0.2 to 0.35% is practically suitable. However, if there is no problem of seizure, the Fe content may be smaller than 0.2%.

The pressure casting was conducted under the following conditions: casting pressure, 700 kgf/m $m^2$; injection speed, 0.15 m/s; sprue speed, 0.78 m/s, casting temperature, 996K; mold temperature, 433K; and shot time lag (time taken from supply of molten metal to the sleeve of the casting equipment until injection), not more than 1 second.

The F materials thus obtained from ADC10 and ADC12 and alloys Nos. 1 to 3 each exhibited tensile strength, 0.2% proof strength and elongation as shown in TABLE 3, and had no significant difference among them as to these characteristics.

These samples were then subjected to the T6 treatment under the following conditions:

for alloys Nos. 1–3 of the invention:

solution treatment at 520° C. for 6 hours, then age-hardening treatment at 160° C. for 7 hours; for alloys Nos. 4 and 5 of the invention, comparative examples 1 and 3, and ADC10 and ADC12:

solution treatment at 510° C. for 6 hours, then age-hardening treatment at 160° C. for 7 hours;

for comparative example 2:

solution treatment at 510° C. for 6 hours, then age-hardening treatment at 180° C. for 4 hours; and for comparative example 4:

solution treatment at 515° C. for 6 hours, then age-hardening treatment at 160° C. for 7 hours.

The samples thus treated exhibited tensile strength, 0.2% proof strength and elongation as shown in TABLE 4.

As seen from TABLE 4, the T6-treated ADC10 and ADC12 each exhibited a tensile strength of not more than 40 kgf/$mm^2$, whereas the T6-treated alloys Nos. 1, 2 and 4 of the invention each exhibited a tensile strength of about 45 kgf/$mm^2$, which was far higher than the desired value, or 35 kgf/$mm^2$. Further, the T6-treated alloys of the present invention exhibited an average elongation of not less than 5.0% though scattering of results was observed around 5.0%.

As has been described, the alloy of the present invention has a Cu content of 3.5 to 5.0% which allows a solution treatment, a Si content of 6.5 to 7.5% which ensures the fluidity suitable for pressure casting, a Mg content of not more than 0.36% which enables a T6-treated material made from the alloy of the invention to enjoy tensile strength, 0.2% proof strength and elongation falling within a desired relationship, and a Fe content of not more than 0.35% which prevents seizure of a cast article by a mold. The alloy of the present invention comprises the above components, and Al and unavoidable impurities forming the balance. Thus, when the alloy is subjected to the T6 treatment after pressure casting, the resulting T6-treated cast alloy exhibits a tensile strength of not less than 35 kgf/$mm^2$ and an elongation of not less than 5.0%.

While certain presently preferred embodiments of the present invention have been described in detail, as will be apparent for those skilled in the art, various changes and modifications may be made in embodiment without departing from the scope of the present invention as defined in the following claims.

What is claimed is:

1. A high-strength aluminum alloy for pressure casting comprising 3.5 to 5.0% of Cu, 6.5 to 7.5% of Si, more than zero and not more than 0.36% of Mg, more than zero and not more than 0.35% of Fe, and the balance comprising Al and unavoidable impurities, wherein said alloy exhibits a tensile strength of not less than 35 kgf/$mm^2$ and an elongation of not less than 5.0% after subjecting said alloy to pressure casting and then to a T6 treatment.

2. A high-tenacity cast aluminum alloy comprising a high-strength aluminum alloy as recited in claim 1 which is pressure-cast and then treated according to a T6 treatment.

3. The high-strength aluminum alloy of claim 1, wherein the amount of Mg is between 0.2% and 0.36%.

4. The high-strength aluminum alloy of claim 1, wherein the amount of Mg is not more than 0.2%.

5. The high-strength aluminum alloy of claim 1, wherein the amount of Fe is from 0.2 to 0.35%.

6. The high-strength aluminum alloy of claim 1, wherein the amount of Fe is smaller than 0.2%.

7. The high-tenacity cast aluminum alloy of claim 2, wherein the amount of Mg is between 0.2% and 0.36%.

8. The high-tenacity cast aluminum alloy of claim 2, wherein the amount of Mg is not more than 0.2%.

9. The high-tenacity cast aluminum alloy of claim 2, wherein the amount of Fe is from 0.2 to 0.35%.

10. The high-tenacity cast aluminum alloy of claim 2, wherein the amount of Fe is smaller than 0.2%.

* * * * *

UNITED STATES PATENT AND TRADEMARK OFFICE

CERTIFICATE OF CORRECTION

PATENT NO. : 6,416,710 B1
DATED : July 9, 2002
INVENTOR(S) : Oshiro et al.

It is certified that error appears in the above-identified patent and that said Letters Patent is hereby corrected as shown below:

Title page,
Item [73], Assignee, should read:
-- [73] Assignee: K.K. Daiki Aluminium Kogyosho,
Yao-shi, JAPAN --

Signed and Sealed this

Twenty-ninth Day of June, 2004

JON W. DUDAS
*Acting Director of the United States Patent and Trademark Office*